US006486428B1

(12) United States Patent
Roux et al.

(10) Patent No.: US 6,486,428 B1
(45) Date of Patent: Nov. 26, 2002

(54) QUICK-RELEASE SWITCH WITH FORCED OPENING WITH IMPROVED MOUNTING TOLERANCE

(75) Inventors: Christian Roux, Coublevie (FR); Jacques Bojoly, St Marcel les Valence (FR); Christian Minodier, Beaumont les Valence (FR); Alain Pigat, Chatuzange le Goubet (FR)

(73) Assignee: Crouzet Automatismes, Valence (FR)

( * ) Notice: Subject to any disclaimer, the term of this patent is extended or adjusted under 35 U.S.C. 154(b) by 0 days.

(21) Appl. No.: 09/830,883

(22) PCT Filed: Oct. 26, 1999

(86) PCT No.: PCT/FR99/02603

§ 371 (c)(1),
(2), (4) Date: May 2, 2001

(87) PCT Pub. No.: WO00/26929

PCT Pub. Date: May 11, 2000

(30) Foreign Application Priority Data

Nov. 3, 1998 (FR) ..... 98 13810

(51) Int. Cl.[7] ..... H01H 5/06
(52) U.S. Cl. ..... 200/453; 200/457
(58) Field of Search ..... 200/409, 453, 200/454, 457, 458, 435

(56) References Cited

U.S. PATENT DOCUMENTS 2,245,634 A * 6/1941 Yingling ..... 200/83
2,641,663 A * 6/1953 Krieger ..... 200/445
3,270,157 A * 8/1966 Johnson ..... 200/457
3,624,332 A * 11/1971 Van Benschoten ..... 200/241
4,578,549 A * 3/1986 Grunst et al. ..... 200/458
5,426,274 A * 6/1995 Bruggemann et al. ..... 200/523
5,532,444 A * 7/1996 Bonrath et al. ..... 200/524

FOREIGN PATENT DOCUMENTS

| | | |
|---|---|---|
| DE | 2 064224 | * 11/1979 |
| DE | 3740360 A | 6/1988 |
| EP | 0134293 A | 3/1985 |
| FR | 2575592 A | 7/1986 |
| FR | 2579009 A | 9/1986 |

* cited by examiner

*Primary Examiner*—Micheal Friedhofer
*Assistant Examiner*—Lisa N Klaus
(74) *Attorney, Agent, or Firm*—Oblon, Spivak, McClelland, Maier & Neustadt, P.C.

(57) ABSTRACT

To improve the possibilities of using a fast-action switch with positive opening, of the end-of-travel type, the switch is equipped with a set of compression springs which cause its moving equipment to rock and with a set of compensating springs which allow its operating plunger to move through an additional travel after switching, without damaging interference with a positive opening paddle. The additional travel is increased by placing the compensating springs between a front conducting element and the moving equipment which rocks at the time of switching.

4 Claims, 2 Drawing Sheets

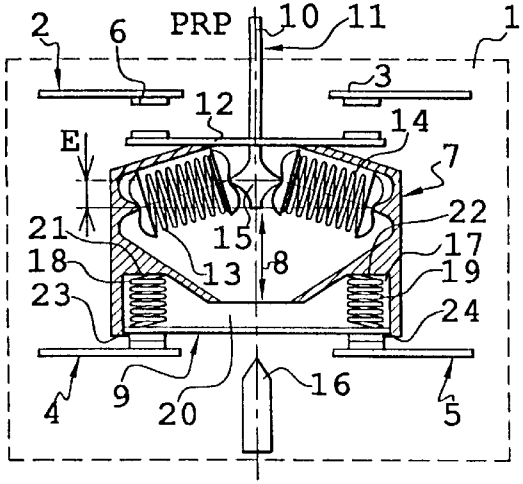
Fig. 1a
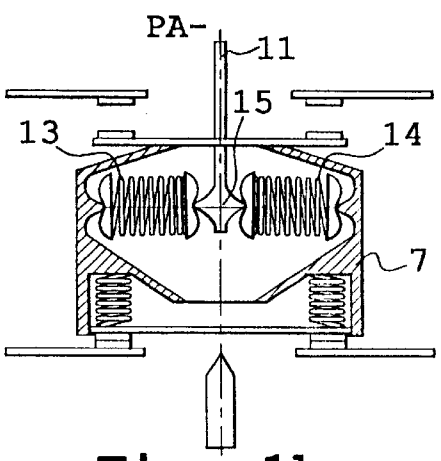
Fig. 1b
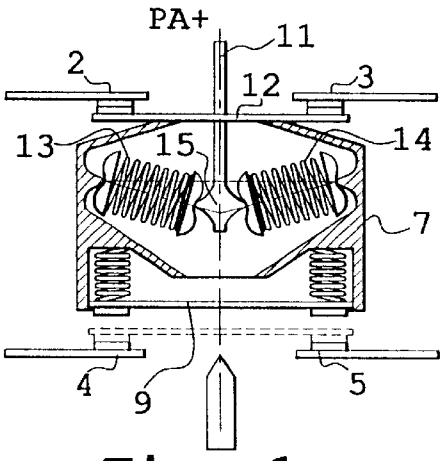
Fig. 1c
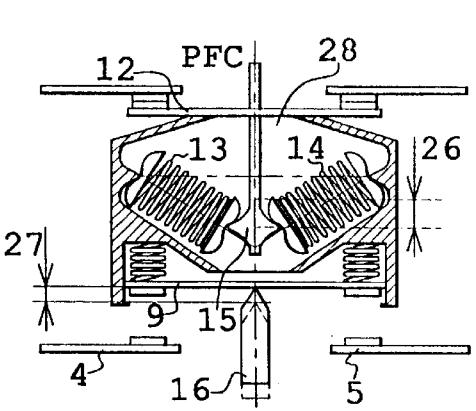
Fig. 1d
Fig. 1e
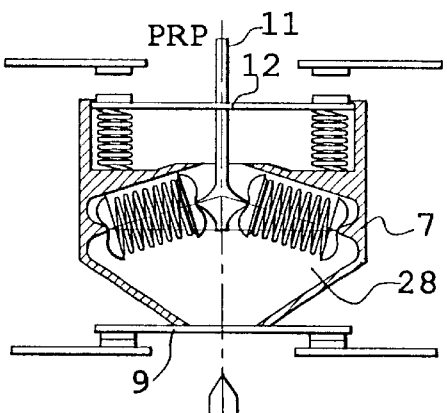
Fig. 1f

QUICK-RELEASE SWITCH WITH FORCED OPENING WITH IMPROVED MOUNTING TOLERANCE

BACKGROUND OF THE OF THE INVENTION

1. Field of the Invention

A subject of the present invention is a fast-action make-and-break switch. Fast-action make-and-break switches are switches in which the current is cut quickly, as opposed to switches in which the separation of electrical contacts is slow and depends on the speed of manual action of an operator. The switch of the invention is more particularly a switch of the end-of-travel type, for which the fitting and therefore usage tolerances are improved. What happens is that, according to the invention, the user has available to him, for an end-of-travel switch of small size, a greater tolerance between a positive opening position (POP) and an end-of-travel position (PFC). The distance separating these two positions can therefore be best used by the user to stop a moving body more easily or to absorb its spread out which has traveled beyond the position POP.

2. Discussion of the Background

A fast-action make-and-break switch that can be used as an end-of-travel switch is known, particularly from French patent, FR-A-2 579 009. The use of these switches is subject to standardized constraints. In particular, in addition to having a fast-action make-and-break mechanism, these switches have to be fitted with a positive opening mechanism to avoid defective operation of the switch when actuated as a result of a contact that has to be disconnected becoming stuck. The principle is as follows. For action exerted on an operating plunger, at the start, moving equipment internal to the switch disconnects contacts which are normally closed (known as normally closed contacts). Thereafter, the fact of continuing to depress the plunger causes a change in state of a lever tasked with separating a conducting element from contacts on which it was resting, if this separation could not occur beforehand. This positive opening has to be capable of detaching the conducting element from the contacts. The "sticking" concerned is that which may have resulted from welding through the passage of a (standardized) short-circuit current of one thousand amperes. What this means is that the rocking mechanism and the lever are very robust in order to perform this unsticking. Under normal circumstances, of course, such unsticking is not needed because the switch will have performed the expected fast-action breaking.

Under normal circumstances, after the expected breaking, the rocking of the lever of the positive opening mechanism tends to bring the latter closer to the normally closed moving conducting element which has been separated. This mechanism has a detrimental consequence. While having its usefulness, it does nonetheless restrict the possibility of continuing to depress the plunger after the lever has come into contact with the conducting element that it has to separate, in addition to the natural separation. What happens is that, if action continues to be exerted on the plunger, the moving equipment becomes crushed and damage is therefore done to the end-of-travel switch.

With a view to obtaining a greater distance between the opening of the contacts for electrical isolation purposes, the aforementioned French patent envisions associating a conducting element with the moving equipment via a set of compensating springs. By taking this approach, the force exerted by the lever would be in a direction in which the moving equipment would tolerate deformation. This being the case, the tolerance on fitting adjustment between a positive opening point POP and an end-of-travel limit PFC is extended typically from a value of 0.5 mm to 1 mm. In other words, with this mechanism, the fitting tolerance or range of use of the fast-action end-of-travel switch is markedly improved.

However, it remains the case that, for a total travel of 5 mm, the depression distance separating a point of action PA, in which the moving equipment rocks, from the positive opening point POP is still great, and of the order of 2 mm. This means that, with such a mechanism, normal initiated opening will occur for a given position PA, whereas positive opening will not occur until the plunger has been pushed in 2 mm further. This difference is annoying to a user. What the user actually wants is, for normal operation or positive operation (and in this case even with slow opening), for the opening of the contact to occur for one and the same depressed position of the switch plunger. Alternatively, if this is not possible, he wants opening to occur at positions which are truly very close together. In practice, in the invention, it will be shown that a precision of the order of 1 mm can be obtained, which is far better than the previous 2 mm.

SUMMARY OF THE INVENTION

In order to overcome this problem, the solution of the invention consists in causing the positive opening action, and the deformation of the moving equipment, to be exerted on one and the same conducting element, the normally closed conducting element, the one at the front of this moving equipment. It will actually be shown that, for the same overall switch size, a greater tolerance can be achieved using the invention. The distance separating the positive opening point from the end-of-travel position will be greater with the invention than in the cited prior art.

A subject of the invention is therefore a fast-action make-and-break switch comprising

- a casing fitted with four electrical contacts, facing each other in pairs,
- inside this casing, moving equipment carrying along, at each end of its movement, a rear conducting element and a front conducting element, these elements being brought respectively and alternately into contact with two first or two second corresponding opposing contacts,
- a set of compression springs resting against this moving equipment and against one end of a plunger for operating the switch,
- a rocking control connected mechanically to the plunger and capable of exerting positive action on the front conducting element when the plunger is in a pushed forward position,
- a set of compensating springs inserted between the moving equipment and one contact element,
- a housing in a plane of the moving equipment to accommodate the set of compensating springs, characterized in that

- this housing is located on the same side as the front conducting element.

BRIEF DESCRIPTION OF THE DRAWINGS

The invention will be better understood upon reading the description which follows and from examining the accompanying figures. These are given merely by way of nonlimiting indication of the invention. The figures show:

FIGS. 1*a* to 1*f*: schematic depictions of the fast-action make-and-break switch of the invention in various positions of operation and its comparison with a depiction of the same type for the prior art;

DETAILED DESCRIPTION OF THE DRAWINGS

Figure 2:
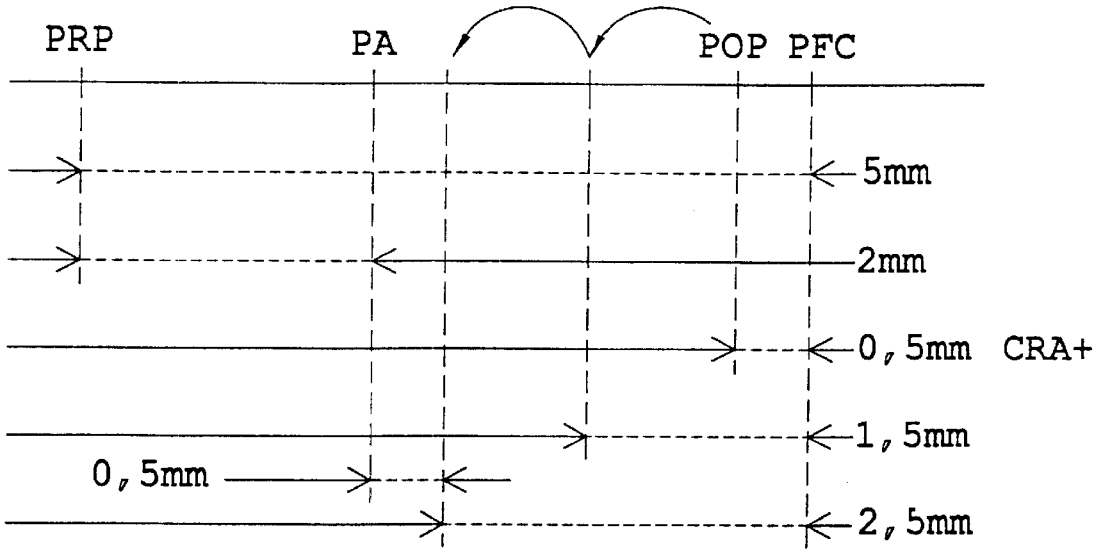
FIG. 2: a diagram showing the various tolerances afforded by the devices of the prior art and, by way of comparison, by the device of the invention.

FIGS. 1*a* to 1*e* show various states of the fast-opening make-and-break switch of the invention. This switch comprises, in a casing 1 depicted schematically, four electrical contacts 2 to 5. These contacts face each other in pairs. In particular, the contact 2 faces the contact 3 and the contact 4 faces the contact 5. These contacts are connected to electrical connections, not depicted. These electrical connections are intended to carry electrical potential according to whether the switch is closed or open. The contacts 2 to 5 comprise, in order to make electrical contact, studs such as 6, possibly covered with a layer of silver or some other material capable of improving the electrical contact and not likely to give rise to deposits if electrical arcs are struck.

Moving equipment 4 is located in the casing 1. This moving equipment carries along conducting elements at each end of a movement depicted by the double-headed arrow 8. A first, front, conducting element 9 is located at the opposite end to one end 10 of a plunger 11 via which the switch of the invention is operated. The plunger 11 is used in particular as a plunger of the end-of-travel type. A rear conducting element 12 is placed securely in the moving equipment, on the other side thereof with respect to the front conducting element 9. The elements 9 and 12 are used to make electrical connections between the contacts 4 and 5 and 2 and 3, respectively.

A set of two compression springs 13 and 14 rests, on the one hand, on the moving equipment 7 and, on the other hand, on another end 15 of the plunger 11. The springs 13 and 14 are in compression. They are oriented as the two sides of an isosceles triangle, the height of which is in the direction of the plunger 11.

Figure 3:
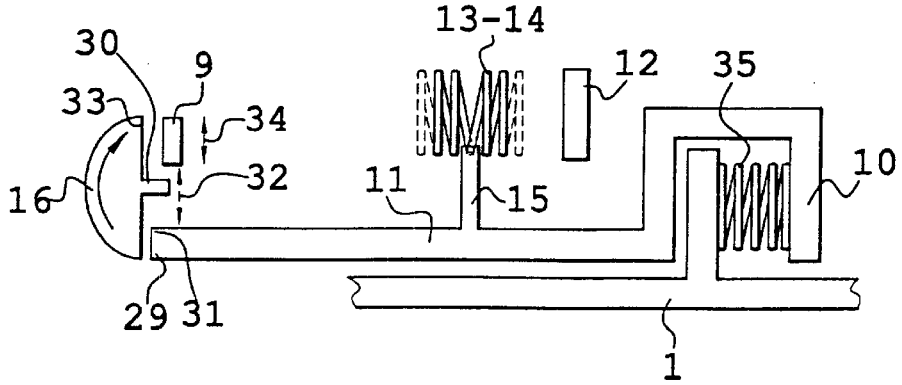
FIG. 3: a schematic depiction of the rocking action used to positively open the switch of the invention.

The switch also comprises a rocking control which will be looked at in greater detail when examining FIG. 3, but the effect of which can be symbolized by the action of a stop 16 on the front conducting element 9. The rocking control is such that the stop 16 moves toward the element 9 when the plunger 11 penetrates the casing 1. Penetration of the plunger 11 is by pushing on this plunger.

The moving equipment also comprises a housing 17 to accommodate a set of compensating springs 18 and 19. In practice, the moving equipment 7 comprises, for this housing 17, a cavity 20 surmounted by the front conducting element 9. The element 9 is held in the cavity 20 by the springs 18 and 19 on the one hand, which rest on this element 9 and on the bottoms 21 and 22 of the cavity, and, on the other hand, by the presence of turned-in rims 23 and 24. The rims 23 and 24 are turned in over the cavity 20 and retain the element 9.

According to an essential feature of the invention, the housing 17 made in the cavity 20 is located on the same side as the front conducting element 9 rather than, as it was in the prior art, on the same side as the rear conducting element 12.

From examining the positions of the switch in FIGS. 1*a* to 1*e*, the improvement afforded by the invention over an equivalent embodiment of the prior art, FIG. 1*f*, will be better understood. The figures presented are entitled, respectively, PRP, position at rest, PA−, position of action just before the fast action, PA+, position of action just after the fast action, POP, positive opening position, PFC, end-of-travel position, and PRP, a state comparable with that of FIG. 1*a* but for an embodiment of the prior art.

In FIG. 1*a*, PRP, the stop 16 is away from the element 9 and the end 10 of the plunger 11 is deployed to its maximum extent. In the position PA−, the plunger is depressed to just before a position of equilibrium, just before fast-action breaking. In the latter instance, the two springs 13 and 14 are almost aligned with one another. They compress. Through a judicious choice of spring weights, the component oriented in the direction of the arrow 8 of the resultant of the reaction exerted by the compression springs 13 and 14 is weaker than the resultant force exerted by the compensating springs 18 and 19, this being the case throughout the travel from PRP to PFC. This being the case, between the position PRP and the position PA− the moving equipment 7 does not move. Above all, the springs 13 and 14, by compressing, change orientation and allow the end 15 of the plunger 11 to penetrate toward the center of the moving equipment 7. FIG. 1*a* shows a distance E, known as the short travel or approach travel, which corresponds to the depression of the plunger from the position PRP to the position PA−. This distance E, for all practical purposes, is generally of the order of 2 mm. It is necessary for correct operation of the end-of-travel switch throughout its life (differential travel, tolerances, internal wear, etc.)

In FIG. 1*c*, position PA+, a very small movement of the plunger 11, has, by the effect of relaxing the compression spring 13 and 14, caused the moving equipment 7 to move quickly with respect to the end 15. The latter can be considered as not having moved from the position of FIG. 1*b* to that of FIG. 1*c*. This being the case, in normal operation, the front conducting element 9 is separated quickly from the contacts 4 and 5 while the rear element 12 comes into contact with the contacts 2 and 3. At this stage, if there had not been further constraints, particularly those imposed by the standard, this operation could have been deemed to be satisfactory.

In the position PA+, the springs 13 and 14 tend to return the plunger 11 toward the front element 9. Either an additional spring stronger than the resultant of the springs 13 and 14 and exerting a force in the opposite direction, but not depicted, then rests on the casing 1 and on the plunger 11 in order to redeploy it or, in the position PA+, the springs 13 and 14 are at rest. For the switch to be reversible, the former solution is adopted.

By contrast, in FIG. 1*d*, it is shown that if the plunger 11 continues to be depressed, this plunger approaches a position known as POP in which the stop 16 comes into contact with the conducting element 9 if the latter has remained stuck to the contacts 4 and 5. If the switch is operated normally, in the position POP, the stop 16 does not come into contact with the conducting element 9. By contrast, if the conducting element has remained stuck in the position POP, it comes into contact with it. Furthermore, it is possible, for the position POP, to adopt not the position in which the stop 16 comes into contact with the element 9 but rather a position in which separation of the contact is guaranteed. This position is embodied by the end 25 of the stop 16.

FIG. 1*e* shows the end-of-travel position in which the plunger 11 has been depressed a little further, by a distance 26 compared with its position in FIG. 1*d*. The distance 26 represents the long additional travel for positive opening. It is represented by the movement of the end 15. At the same time as the end 15 moves by the additional travel 26, the stop 16 moves by an interference distance 27. It will be seen later on why the distance 27 is not equal to the distance 26 while at the same time being mechanically linked thereto.

In this type of operation, the result is that the moving equipment 7 has, in order to contain the compression springs 13 and 14 in their position corresponding to FIG. 1*a* and in their position corresponding to FIG. 1*e*, to have the shape of an asymmetric lozenge. The asymmetry stems from the benefit of having the position PA closer to the position PRP than to the position PFC in all switches. This makes use thereof easier. This asymmetric lozenge shape is to be understood as meaning an imperfect lozenge of which part, in this instance the part located on the same side as the front conducting element 9, is closed at a more acute angle than the part which closes on the same side as the conducting element 12. As a result of this, the cavity 20 may have a U-shape, in which the branches of the U can be far deeper than would be the case if this cavity had been formed on the side where the angle at which the lozenge closes is more obtuse. The branches of the U embrace the pointed corner of the asymmetric lozenge formed by a cavity 28 of the moving equipment 7 in which the springs 13 and 14 move. In FIG. 1*e* it can be seen that the asymmetry results from the accentuated inclination of the springs 13 and 14 as a result of the additional depression of the plunger 11.

By contrast, FIG. 1*f* shows a comparison of what occurs in the prior art. For the same movement of the front and rear conducting elements 9 and 12, with the same asymmetric shape of the lozenge-shaped cavity 28 of the moving equipment 7, the overall size of the switch has to be longer (in the direction of thrust of the plunger 11). If it were not longer, the additional travel 26 and the additional travel 27 would have to be reduced. So, for a given embodiment with given compression and compensating springs and with a given size of cavity 28 (which remains shaped as an asymmetric lozenge), the distance 26 can be greater with the invention.

FIG. 2 shows, as a comparison, the position of the end 15 in the positions PRP, PA, POP and PFC in the prior art, in the improvement made in the aforementioned patent and according to the invention. In the prior art, the short initial travel, or approach travel, is of the order of 2 mm whereas the total travel is normally of the order of 5 mm. Without the improvement afforded by the compensating springs, the residual guaranteed positive opening travel CRA+ is of the order of 0.5 mm. In practice, the distance separating the positions PA and POP was previously linked only to tolerances on the manufacture of the switches. With the presence of the compensating springs mounted as per the aforementioned patent, the position POP can be brought about 0.5 mm closer to the position PA. According to the invention, the bottom line in FIG. 2, the position POP will be brought 1.5 mm closer so that the remaining distance between the position PA and the new position POP is now merely of the order of 1 mm.

FIG. 3 shows, on the plunger 11, the end 10, the end 15 which drives the springs 13 and 14 and an operating end 29 which operates the stop 16. The stop 16, also known as a paddle, essentially has an axis of rotation 30 which here is perpendicular to the plane of FIG. 3 and to the elongate direction of the plunger 11. At the instant when the positive opening action occurs, the end 29 presses via a bearing point 31 on the paddle 16. This pressure is exerted with an operating radius 32. At this same instant, an end 33 of the paddle comes into contact with the front conducting element 9 (if it is stuck) . The operating radius of action at the end 33 is the radius 34 whose value is, to start with, greater than the radius 32. This being the case, there will be a large forward movement at the end 33 for a short forward movement at the end 29. By contrast, toward the end of the thrust, the paddle 16 has rocked. The end 33 has a working radius for pressing on the element 9 which is lower in value than the radius 34. By contrast, the radius 32 increases. The consequence of this is that toward the end of the travel, the additional travel 26 of the plunger 11 will be greater than the additional travel 27 of the front conducting element 9.

FIG. 3 again shows part of the casing 1 and, schematically, a compressed additional spring 35 tending to cause the plunger 11 to deploy. The distance PRP-PFC in practice corresponds to the deflection of the spring 35.

The end result of the invention is that, although the additional travel 27 can be greater than it was in the prior art, by virtue mainly of the asymmetry, the additional travel 26 will also of course be greater. Furthermore, as indicated hereinabove, the positive opening point POP will be brought very close to the point of action PA. The invention therefore presents the user with the advantage of a longer guaranteed positive opening additional travel CRA+ without any increase in the size of the end-of-travel switch.

What is claimed is:

1. A fast-action make-and-break switch comprising:

a casing fitted with a first pair of electrical contacts and a second pair of electrical contacts, said first pair of electrical contacts facing said second pair of electrical contacts;

moving equipment disposed inside said casing and carrying along at each end of a movement a rear conducting element and a front conducting element, said rear conducting element being brought alternately into contact with each of said first pair of electrical contacts, and said front conducting element being brought alternatively into contact with each of said second pair of electrical contacts;

a set of compression springs resting against the moving equipment and against one end of a plunger for operating the switch;

a rocking control connected mechanically to the plunger and configured to exert positive action on the front conducting element when the plunger is in a pushed forward position;

a set of compensating springs inserted between the moving equipment and one of the front and rear conducting elements; and a housing in a plane of the moving equipment to accommodate the set of compensating springs;

wherein the housing is located on a same side as the front conducting element.

2. The switch as claimed in claim 1, wherein the compensating springs exert a force on the front conducting element which is higher than a resultant of a compressive force exerted by the compression springs, in a direction of thrust.

3. The switch as claimed in claim 1, wherein the moving equipment comprises a housing shaped as an asymmetric lozenge for accommodating the compression springs, the compensating springs' housing being located on a same side as a most pointed corner of the asymmetric lozenge.

4. The switch as claimed in claim 2, wherein the moving equipment comprises a housing shaped as an asymmetric lozenge for accommodating the compression springs, the compensating springs' housing being located on a same side as a most pointed corner of the asymmetric lozenge.

* * * * *